US008896204B2

(12) United States Patent
Lankes et al.

(10) Patent No.: US 8,896,204 B2
(45) Date of Patent: Nov. 25, 2014

(54) HIGH-PRESSURE DISCHARGE LAMP WITH A STARTING AID

(75) Inventors: Simon Lankes, Falkensee (DE); Stefan Lichtenberg, Holzwickede (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/125,955

(22) PCT Filed: May 22, 2012

(86) PCT No.: PCT/EP2012/059423

§ 371 (c)(1), (2), (4) Date: Dec. 13, 2013

(87) PCT Pub. No.: WO2012/171752

PCT Pub. Date: Dec. 20, 2012

(65) Prior Publication Data

US 2014/0091706 A1 Apr. 3, 2014

(30) Foreign Application Priority Data

Jun. 14, 2011 (DE) ..... 10 2011 077 487

(51) Int. Cl.

*H01J 65/04* (2006.01)
*H01J 61/54* (2006.01)
*H01J 61/34* (2006.01)

(52) U.S. Cl.

CPC ..... *H01J 65/042* (2013.01); *H01J 61/547* (2013.01); *H01J 61/34* (2013.01)
USPC ..... 313/607; 313/627

(58) Field of Classification Search

USPC ..... 313/567, 627, 628, 640–643
See application file for complete search history.

(56) References Cited

U.S. PATENT DOCUMENTS

| | | | | |
|---|---|---|---|---|
| 5,911,919 | A | 6/1999 | Billings | |
| 6,593,706 | B1 | 7/2003 | Sze et al. | |
| 8,227,990 | B2 | 7/2012 | Buttstaedt et al. | |
| 2002/0000780 | A1 * | 1/2002 | Matsumoto et al. | 315/344 |
| 2003/0034738 | A1 | 2/2003 | Kanegae et al. | |
| 2010/0181926 | A1 | 7/2010 | Ozasa et al. | |
| 2011/0316419 | A1 * | 12/2011 | Lapatovich | 315/39 |

FOREIGN PATENT DOCUMENTS

| | | | |
|---|---|---|---|
| DE | 202006016189 | U1 | 2/2007 |
| DE | 102009047861 | A1 | 3/2011 |
| JP | 2007073436 | A | 3/2007 |
| WO | 2008007284 | A2 | 1/2008 |
| WO | 2012045366 | A1 | 4/2012 |

OTHER PUBLICATIONS

English language abstract of JP 2007073436 A dated Mar. 22, 2007.
Search Report issued in the corresponding PCT application No. PCT/EP2012/059423, dated Sep. 7, 2012, 10 pages.

* cited by examiner

*Primary Examiner* — Tracie Y Green

(57) ABSTRACT

A high-pressure discharge lamp with a starting aid, may include a discharge vessel, wherein the discharge vessel has two ends with seals, in which electrodes are fastened, wherein the starting aid is fitted on the outside of the discharge vessel, wherein the starting aid has a local field amplifier having a configuration with at least one tip or edge or structure with a small radius of curvature, and wherein the starting aid produces a corona discharge which emits UV radiation into the discharge vessel.

12 Claims, 10 Drawing Sheets

HIGH-PRESSURE DISCHARGE LAMP WITH A STARTING AID

RELATED APPLICATIONS

This application is a national stage entry according to 35 U.S.C. §371 of PCT application No.: PCT/EP2012/059423 filed on May 22, 2012, which claims priority from German application No. 10 2011 077 487.4 filed on Jun. 14, 2011.

TECHNICAL FIELD

Various embodiments relate to a high-pressure discharge lamp. Such lamps are in particular high-pressure discharge lamps for general lighting or for photooptical purposes.

BACKGROUND

DE 10 2009 047 861 discloses a high-pressure discharge lamp with a discharge vessel, in which a starting aid is used at the end of the discharge vessel.

Free electrons must be produced in the discharge vessel for starting high-pressure discharge lamps. Until now, this has been achieved by radioactive krypton-85 in the fill gas.

Gas discharge lamps without any radioactivity in the fill gas can start markedly more reliably when starting aids are used. If the lamp geometry does not permit an additional light source such as a UV enhancer, sometimes a discharge in an outer bulb can be used as UV light source; see U.S. 2003034738, WO2008007284. By suitably selecting the gas in the outer bulb, the outer bulb discharge usually has a lower starting voltage than the lamp. However, these voltages are still higher than the starting voltages of lamps filled with radioactive krypton-85.

SUMMARY

Various embodiments provide a high-pressure discharge lamp which can be started using simple inexpensive means.

This applies in particular to metal halide lamps, wherein the material of the discharge vessel is usually ceramic or quartz glass.

Various embodiments relate to high-pressure discharge lamps including a discharge vessel consisting of quartz glass or ceramic, possibly with an outer bulb. Various embodiments relate to in particular to discharge lamps which are started with the aid of a starting pulse of typically from 4 to 5 kV, including a discharge vessel consisting of quartz glass or ceramic without radioactive admixtures in the discharge vessel possibly a gas-filled outer bulb.

Various embodiments relate to a solution which, by virtue of a simple, inexpensive design, ensures effective starting of such radioactivity-free lamps even with comparatively low starting pulses.

Primarily, discharge lamps for general lighting which generally have a gas-filled outer bulb and are designed for a service life of 6000 h or more are affected. The disclosure can also be applied to photooptical lamps without an outer bulb, in particular to xenon high-pressure discharge lamps.

Such high-pressure discharge lamps are started with the aid of special starting devices. The starting properties of these starting devices are established by corresponding standards. The conditions in the discharge vessel (volume, electrode spacing, fill gas, filling pressure, quantity of Hg, quantity and nature of the metal halides) need to be matched to one another in such a way that the lamp starts safely given the established starting conditions. Furthermore, as the service life increases, the voltage required for starting increases. This can mean that old lamps no longer start using conventional starting devices. The starting capacity does need to be ensured over the entire service life, however.

Various embodiments describe a solution which ensures safe starting of high-pressure discharge lamps.

UV radiation is used for reliable starting of krypton-85-free high-pressure discharge lamps. If the lamp geometry does not permit an additional light source, a discharge outside the discharge vessel, in particular in an outer bulb, can be used as UV light source. Advantageous here is a dielectrically impeded discharge, in which only an auxiliary starting electrode is in contact with the surrounding air or a gas in the outer bulb. It is advantageous for the starting voltage of the discharge outside on the discharge vessel or in the outer bulb if free electrons can be produced by field emission. For this, high electrical fields need to be generated on the auxiliary starting electrode. The aim of the disclosure is to produce field intensity maxima outside the discharge vessel, in particular in the outer bulb, in an inexpensive manner.

A reduction in the starting voltage on the outside, possibly in the outer bulb, can be achieved by the use of field emission of electrons from the auxiliary starting electrode. For this, as large a number of locations with a high electrical field intensity as possible needs to be produced on the auxiliary starting electrode.

Field intensity maxima result on the auxiliary starting electrode at locations with severe surface curvature. These can be points or ridges produced during manufacture. These are often poorly reproducible. In the case of the frequently used auxiliary starting wires, these ridges only occur at the ends. Therefore, only small areas contribute to starting of the external discharge, and this is therefore not very effective.

U.S. Pat. No. 6,624,580 describes that a suitable outer bulb fill gas can be excited with the aid of a dielectrically impeded discharge such that sufficient UV radiation for starting of the lamp is produced. The starting voltages required for this are in the range of from 10 to 20 kV, however, with the result that even this method cannot be applied for discharge lamps which need to start on a starting pulse of 3-5 kV. A prerequisite for the present disclosure consists in that a gas is present on the outside on the discharge vessel, in particular in the outer bulb of the lamp, which gas is suitable for forming a corona discharge, for example Ar, Xe or else air, but also other gases or gas mixtures. The filling pressure can in this case be between 1 bar and 0.1 mbar. Alternatively, a discharge vessel can also be operated directly on air, i.e. without an outer bulb. A suitable design of an arrangement envisages that an electrically conductive arrangement is fitted on the outside at the end of the discharge vessel as close as possible to the electrode, which electrically conductive arrangement has one or more very small radii or sharp edges and is electrically conductively connected to the power supply line of the counterelectrode (contacted variant). Alternatively, the auxiliary starting arrangement can also be electrically conductively connected to an identical arrangement on the other side of the discharge vessel without any contact to one of the two power supply lines (capacitively coupled variant).

A particularly simple form of the disclosure in the contacted variant envisages that a thin wire is attached to one end of the discharge vessel in such a way that the wire end is positioned as closely as possible to the one electrode and the other wire end is connected to the power supply line of the counterelectrode. Close contact in the central region of the discharge vessel is not required.

As the capacitively coupled variant, a wire is positioned at both ends of the discharge vessel in such a way that each wire end is fitted as closely as possible to an electrode. Alternatively, films or laminations as described above are arranged at both ends of the discharge vessel and are connected to one another. Furthermore, an asymmetrical design is possible, which envisages an arrangement for the formation of the corona discharge only on one side of the discharge vessel and realizes as effective capacitive coupling as possible on the other side.

The disclosure enables very simple technical arrangements with which discharge lamps having the abovementioned properties start safely using starting devices with a starting pulse of 3-5 kV. Particularly advantageously, the disclosure is used in sodium-containing lamps in the capacitively coupled variant. The starting aid according to the disclosure is markedly more effective than a similarly designed conventional starting aid since the corona discharge of the structure of a starting aid forms already at lower voltages than in the case of a dielectrically impeded discharge in the burner interior.

The effectiveness of a starting aid with pinch-sealed burners is often not very high since the auxiliary starting arrangement needs to be passed around the entire pinch seal and the pinch seal takes up a large cross-sectional area, with the result that the induced electrical fields are only small. Fuse seals are therefore better suited. The proposed disclosure makes it possible to position a starting aid in a targeted manner at the point of at least one film in the end of the discharge vessel, with the result that a comparatively large electrical field is induced here. In the case of the known designs of starting aids, the distance between the electrode and the wall inner face of the discharge vessel in the region of the starting aid is critical for the effectiveness since, in this region, a discharge is induced. In particular in the case of a discharge vessel consisting of quartz glass, this distance can be produced such that it is reproducible only with difficulty, however. It follows from this that the effectiveness of the starting aid is also subject to corresponding fluctuations. In the present disclosure, a discharge is produced outside the discharge vessel. The distance from the outer wall of the discharge vessel which is relevant here can be set easily and can be kept constant easily using manufacturing technology.

The design of the starting aid is very simple and inexpensive since, for example, only a thin wire is required. By virtue of being applied externally on the discharge vessel, both the burner and the outer bulb can be produced in accordance with the conventional methods without any changes.

The auxiliary starting component touches the discharge vessel only at the ends, with the result that it is not subjected to the same level of thermal loading as components which are in contact with the discharge vessel in the central region. Thus, the choice of materials is simplified.

Since the wire is preferably a thin wire, the light emerging from the discharge vessel is shielded much less than in the case of other auxiliary starting designs.

A high-pressure discharge lamp with a starting aid is disclosed, including a discharge vessel, wherein the discharge vessel has two ends with seals, in which electrodes are fastened, wherein a starting aid is fitted on the outside of the discharge vessel, wherein the starting aid has a local field amplifier having a configuration with at least one tip or edge or structure with a small radius of curvature, wherein the starting aid produces a corona discharge which emits UV radiation into the discharge vessel.

In a further embodiment, the high-pressure discharge lamp is configured such that the discharge vessel is surrounded by an outer bulb, in particular wherein the outer bulb is filled with ionizable gas, wherein the starting aid is accommodated in the outer bulb, and wherein the gas is selected from the group consisting of noble gases, air, nitrogen or mixtures thereof, in particular Ar, Xe or air.

In a still further embodiment, the starting aid is a section of a wire or a wire piece, wherein the starting aid has a configuration in cross section which has edges, in particular a polygon with straight or curved sections, or a wire section which is round in cross section and has, over a graduated circle, a structure with edges or points.

In a still further embodiment, the starting aid is a fine wire with a diameter of from 5 to 400 μm, preferably from 10 to 150 μm.

In a still further embodiment, the starting aid is a spot face on a wire.

In a still further embodiment, the starting aid is an auxiliary part which interacts with at least one section of a wire, in particular a film which is held at the end of the discharge vessel by means of the wire or a fine wire with a diameter of from 5 to 400 μm, preferably from 10 to 150 μm, which is spun onto the wire.

In a still further embodiment, the starting aid is galvanically or capacitively coupled.

In a still further embodiment, the starting aid includes a material which has a low electron work function.

In a still further embodiment, the starting aid is fitted at least at the level of a film in the region of the end of the discharge vessel.

In a still further embodiment, the starting aid is a rolled wire which is in particular twisted.

In a still further embodiment, the gas in the outer bulb has a cold filling pressure of from 0.1 mbar to 1 bar, preferably up to 200 mbar, in particular up to 1.5 mbar.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION

The following detailed description refers to the accompanying drawings that show, by way of illustration, specific details and embodiments in which the disclosure may be practiced.

Figure 1A:
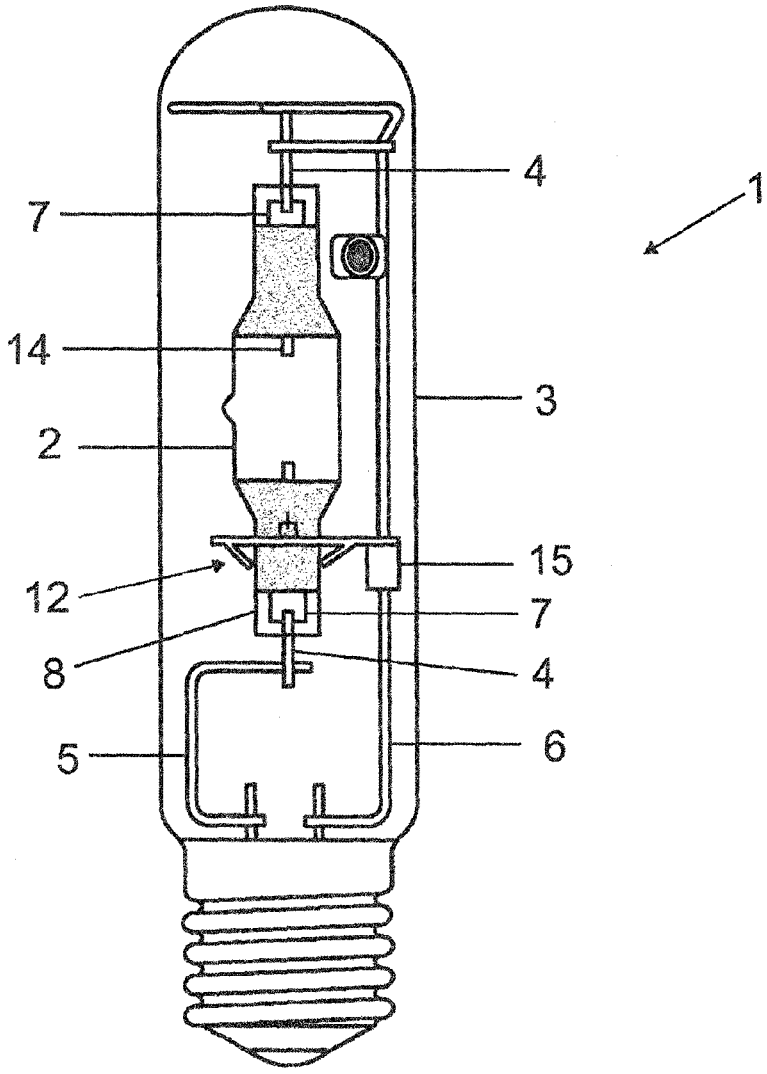
FIGS. 1A to 1C show a high-pressure discharge lamp with a starting aid, first exemplary embodiment (FIG. 1A) and detail view of the clip therefor (FIGS. 1B and 1C)
Figure 1B:
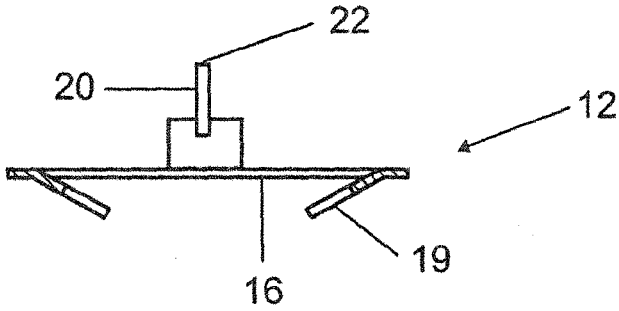
Figure 1C:
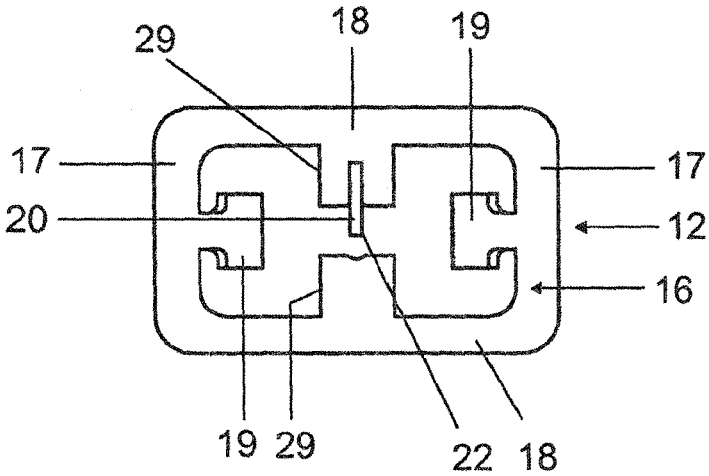

FIGS. 1A to 1C show a schematic illustrating the basic design of a high-pressure discharge lamp 1 with a starting aid 12. Said high-pressure discharge lamp has a discharge vessel 2 consisting of quartz glass, which is accommodated in an outer bulb 3. The outer bulb is filled with argon at 0.1 to 1 bar coldfilling pressure, preferably up to 1.5 mbar. The outer supply lines 4 of the discharge vessel which make contact with electrodes 14 in the interior are connected to two framework wires 5 and 6. A short framework wire 5 leads to a first film 7 in a pinch seal 8 of the outer bulb. A long framework wire 6, often referred to as bow wire, leads to a second film 7 in a second pinch seal 8. The discharge vessel 2 has a fill consisting of an ionizable gas, generally argon or xenon, mercury and metal halides, as is known per se.

A starting aid, see FIGS. 1B and 1C, in this case in the form of a clip 12, is positioned as a collar around a first pinch seal 8 of the discharge vessel and is connected to the bow wire 6 via an angular piece 15. The clip 12 has a frame part 16, which is shaped in the manner of a picture frame, with two narrow sides 17 and two longitudinal sides 18. A sprung lug 19 and 29 which points inwards into the cavity of the frame rests approximately in the center on each side in order to press the clip against the pinch seal, as is known per se. The lugs are bent out of the plane of the frame 16 in opposite directions in pairs. In order to induce a corona discharge in the outer bulb, the clip additionally has a short wire piece 20, which is attached to a lug 29 which fixes a broad side 18 and is bent back in the direction of the discharge volume, and which wire piece protrudes beyond said lug in the direction of the discharge volume. The free point 22 of the wire piece induces a corona discharge in the surrounding gas in the outer bulb. This corona discharge is further assisted by the fact that the short wire piece 20 has wholly or sectionally an embossed structure, as is explained in more detail in FIG. 3A to 3F.

Figure 2:
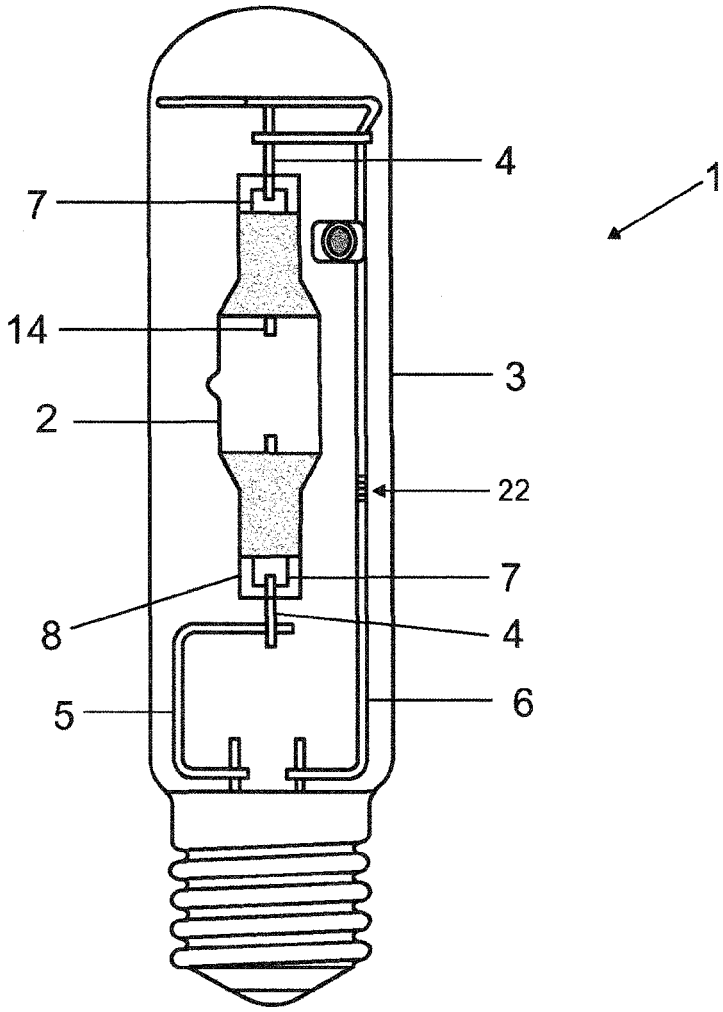
FIG. 2 shows a detailed view of a further exemplary embodiment of a starting aid.

FIG. 2 shows a similar lamp 1, in which identical components have been provided with the same reference numerals. In contrast to the first exemplary embodiment, this exemplary embodiment does not have a clip. Instead, the bow wire 6 has a structured section 22, which acts directly as starting aid. The embossed structure or applied structure of the section 22 induces a corona discharge in the surrounding gas in the outer bulb. The section 22 has an embossed structure, as is explained in more detail in FIG. 3A to 3F.

FIG. 3A to 3F show exemplary embodiments of the section 22, in which points and ridges are produced on a section 22 of a wire piece 20 or of the bow wire 6 or of the short wire 5 with the aid of an embossed structure. This can be applied inexpensively in the form of knurling, scraping (see in this regard the technique as described in DE 202006016189U1), sandblasting or another method of surface structuring. However, care should be taken to ensure here that no notable local reduction in the cross section of the wire and therefore reduced chemical stability is brought about thereby. The particular advantage of this method of embossing consists in that this is a technique which is well known per se, which is easily reproducible and which can be adjusted most precisely to the specific requirements. In the case of an application to the wire piece of the clip, the mechanical stability plays only a subordinate role, in comparison with an application to the bow wire 6.

Figure 3A:
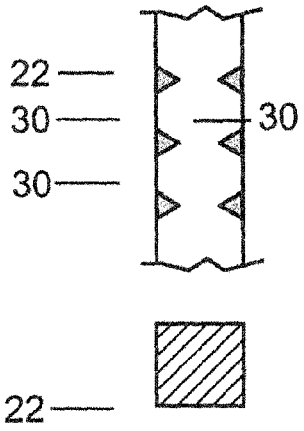
FIGS. 3A to 3F show a further exemplary embodiment of a starting aid.
Figure 3B:
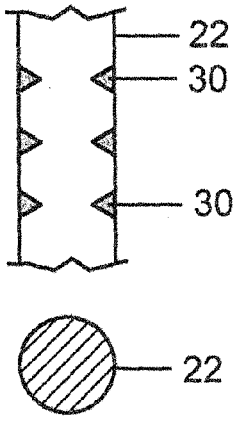
Figure 3C:
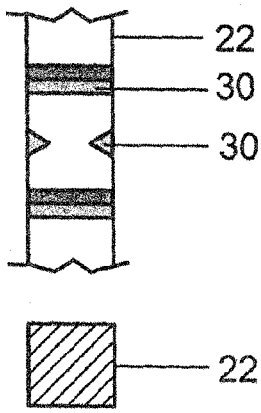
Figure 3D:
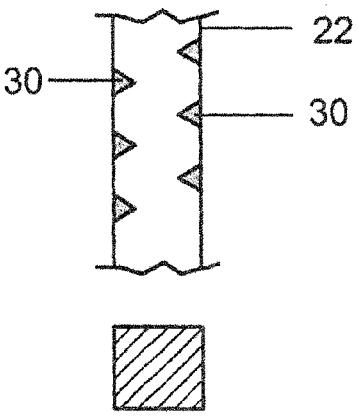
Figure 3E:
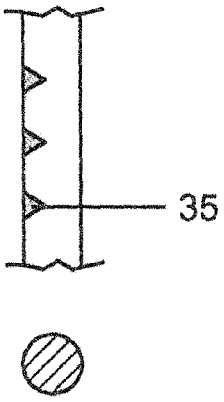
Figure 3F:
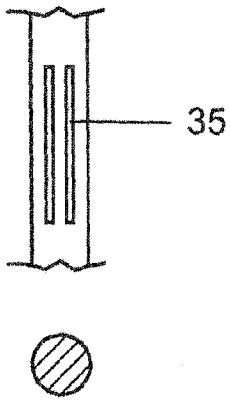

FIG. 3A shows a section 22 which has a square shape in cross section, in particular as a section of the power supply line 6. In this case, transverse grooves 30 are applied in opposite sides in each case at the same height. In FIG. 3D, the design is similar, but the transverse grooves 30 are each applied with an offset with respect to one another. In FIG. 3C, transverse grooves 30 in the form of V-shaped notches are each applied alternately to different sides of the wire with a square shape. In FIG. 3B, a section 22 which is round or disk-shaped in cross section, i.e. with the generally conventional cross section, is shown. The transverse grooves 30 are in this case laterally applied notches, which are opposite one another, in a similar way to in the case of a chicken ladder. In principle, transverse grooves on only one side of the section 22 (see FIG. 3E) or else sections 22 with longitudinal grooves 35 (see FIG. 3F) are also sufficient.

Figure 4A:
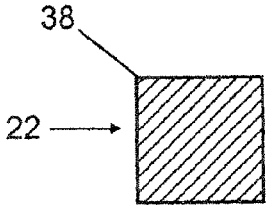
FIGS. 4A to 4I show a further exemplary embodiment of a starting aid.
Figure 4B:
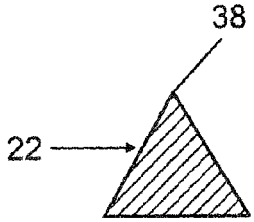
Figure 4C:
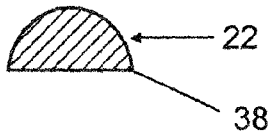
Figure 4D:
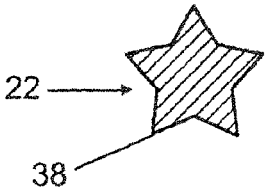
Figure 4E:
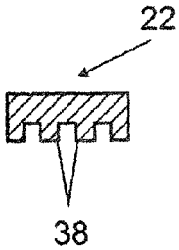
Figure 4F:
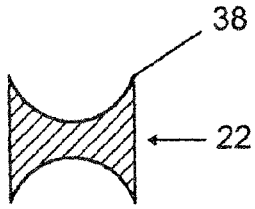
Figure 4G:
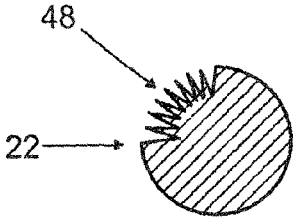
Figure 4H:
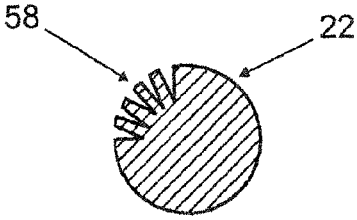
Figure 4I:
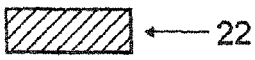

Preferably, the embossed structure is also applied to a section of a framework wire, preferably to the long framework wire 6, without any clip construction, to be precise approximately at the level of one or else both electrodes. The joint use of a clip and a bow wire with starting aids is also possible. A separate stating aid with an embossed structure which is fastened to the framework is also possible. FIGS. 4A to 4I show exemplary embodiments which, in a targeted manner, provide the possibility of using field peaks over the length of the section 22. In this case, profiled wires are used. Such profiled wires have, owing to the manufacture, edges 38 with small radii of curvature. Specific examples are bow wires 6, wires 20 or sections 22 with a simple square cross section (see FIG. 4A), i.e. without an embossed structure, or else bow wires 6 or sections 22 with cross sections in the form of a triangle (FIG. 4B) or a rectangle (FIG. 4I). Particularly pronounced edges 38 can also be achieved with a particular profile configuration, in particular a D profile (FIG. 4C), a star profile (FIG. 4D), a profile similar to a key bit (FIG. 4E), a dumbbell-like profile (FIG. 4F) is suitable. Further exemplary embodiments are wires 20 or sections 22 which are round in cross section but are provided sectionally with longitudinal grooves 35 over a graduated circle of their circumference. In this case, the grooves themselves can have pointed edges 48 (triangular in cross section in the form of an acute-angled triangle) or flattened edges 58 (trapezoidal in cross section).

Figure 5A:
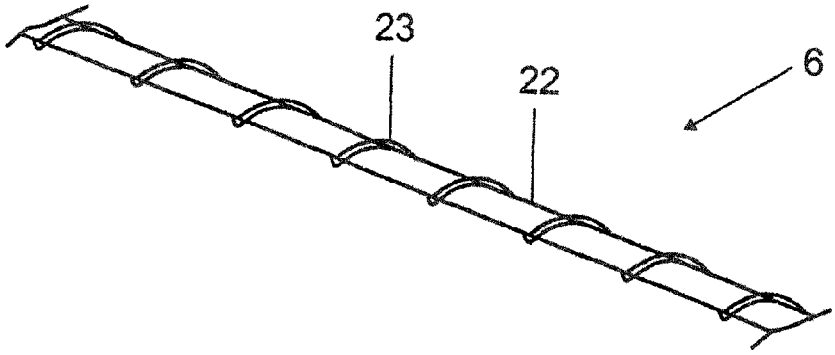
FIGS. 5A and 5B show a further exemplary embodiment of a starting aid.
Figure 5B:
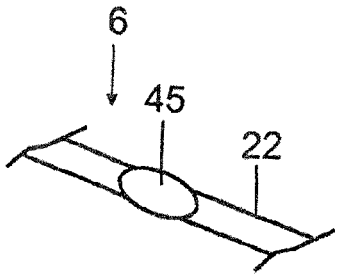

FIG. 5A shows a further exemplary embodiment, namely one in which an auxiliary starting wire has a fine wire 23 wound around it as section 22. In this case, the fine wire 23 ensures the small radii of curvature and therefore high field intensities without the mechanical properties of the starting aid being negatively influenced. Such a design is therefore very suitable for the long power supply line 6. In particular, the wires 20 or bow wires 6 can be rolled to form thin films or can be provided with a flattened section 45 (FIG. 5B). The diameter of the fine wire 23 is advantageously in the range of from 10 to 150 μm, and the diameter of the section 22 to which the fine wire is applied is typically in a range from 1 to 3 mm.

Further forms of twisting or wrapping of wires are possible. Similarly, thin-rolled films with correspondingly sharp edges can likewise be twisted. The resultant field boosting as a result of ridges is in principle applicable for all metals. Particularly advantageous in connection with the abovementioned geometry variations are metals or compounds which are characterized by a low work function; see, for example U.S. Pat. No. 5,911,919. For the variant of the support wire with a fine wire spun around it, it is sufficient if the fine wire consists of a material with a low work function or is coated by this material. Emissive materials are in particular carbides or borides of Hf, Zr, Ti, in particular as a layer on wires or introduced into a matrix on the basis of metals such as W, Ta, Re or else Mo.

Figure 6:
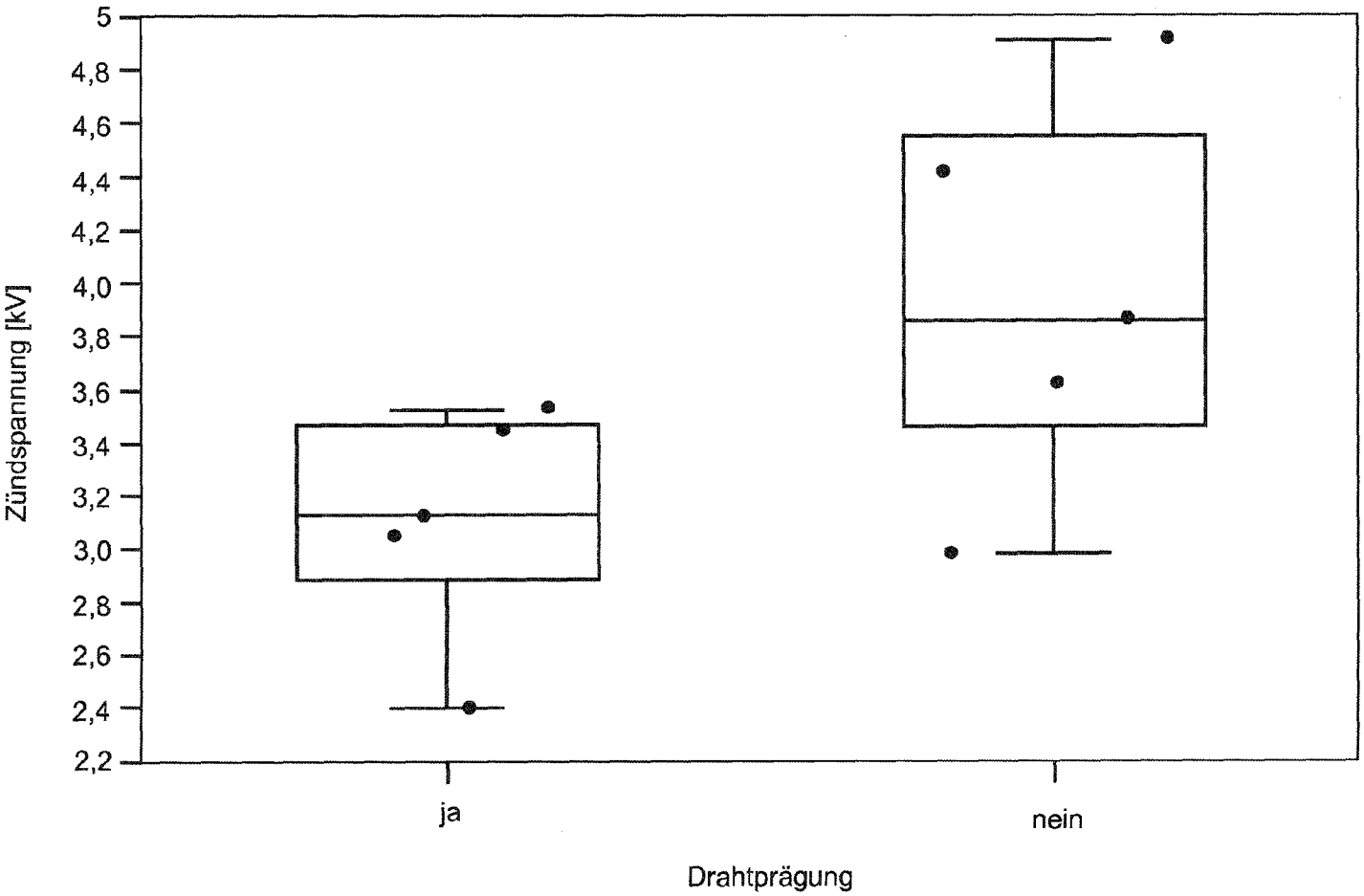
FIG. 6 shows a graph comparing the starting voltage with and without starting aids.

By virtue of the configuration of the starting aid described in the disclosure, it is possible to avoid radioactivity in the fill gas even in lamps in which no additional UV light source can be used. Lamps without radioactivity with simple starting aids (not in accordance with the disclosure) already reach lower starting voltages than those which are completely without a starting aid. However, these starting voltages are still above those of lamps with radioactivity. Direct replacement on the market without any change to the operating device is therefore not always possible. This is only possible by the configuration according to the disclosure of the starting aid, i.e. the targeted, reproducible introduction of locations with a small surface curvature (ridges, points, edges). Such profiling of a wire results in a reduction of the starting voltage. Depending on the nature and the position of the profiled section, in this case a noticeable reduction in the starting voltage is achieved, as shown in FIG. 6. Instead of 4 kV without a profile, now only approximately 3 kV are required. A typical length for such a section 22 is from 1 to 5 mm.

In a preferred embodiment, the starting aid is purely capacitive. Here it is a matter of the effective structure being applied as close as possible to the discharge vessel, to be precise preferably in the region of the films at the ends of the discharge vessel. The effective structure can in this case be located in the region of a film, alternatively in the region of both films, or can extend over the entire length of the starting aid.

Figure 7:
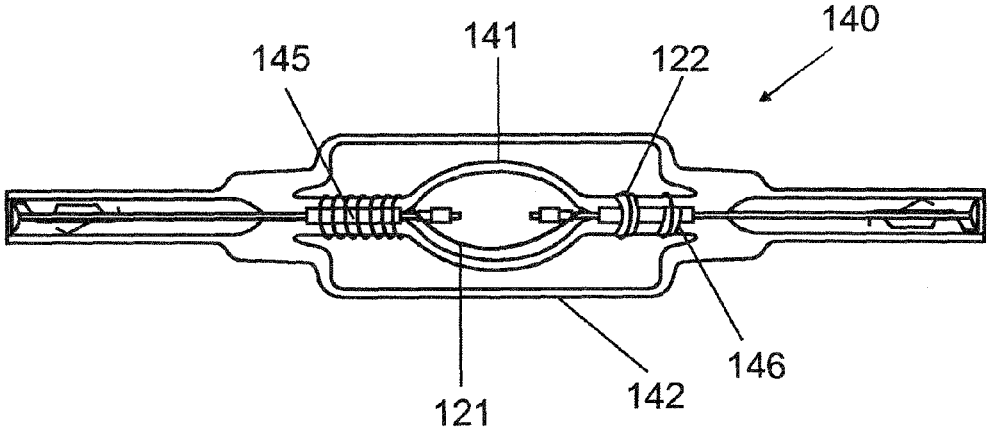
FIG. 7 shows an exemplary embodiment for a capacitive starting aid.

FIG. 7 shows a high-pressure discharge lamp 35, in which a discharge vessel 36 is provided with two ends 37, which are in the form of cylindrical fuse seals. An outer bulb 38 is fastened at the ends of the fuse seals. The starting aid 39 is in this case a wire, which is distributed symmetrically between the two fuse seals. Beneath the wire, a film is pushed in sectionally, the edges of said film having an effect which assists starting and reduces the starting voltage.

Figure 8:
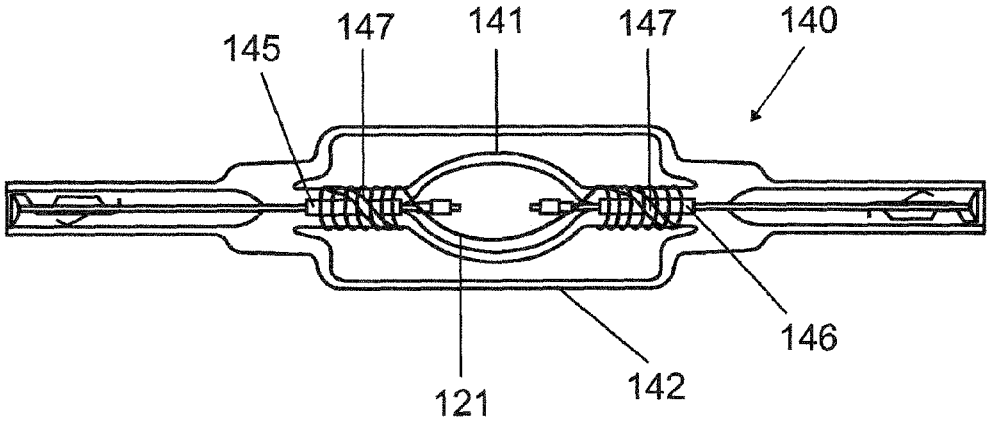
FIGS. 8 to 11 show further exemplary embodiments of capacitive starting aids.

FIG. 8 shows a very similar exemplary embodiment of a lamp 35 in which a film is applied to both ends in helical fashion and is held merely by the turns of the wire without exactly following the turns of the wire.

Figure 9:
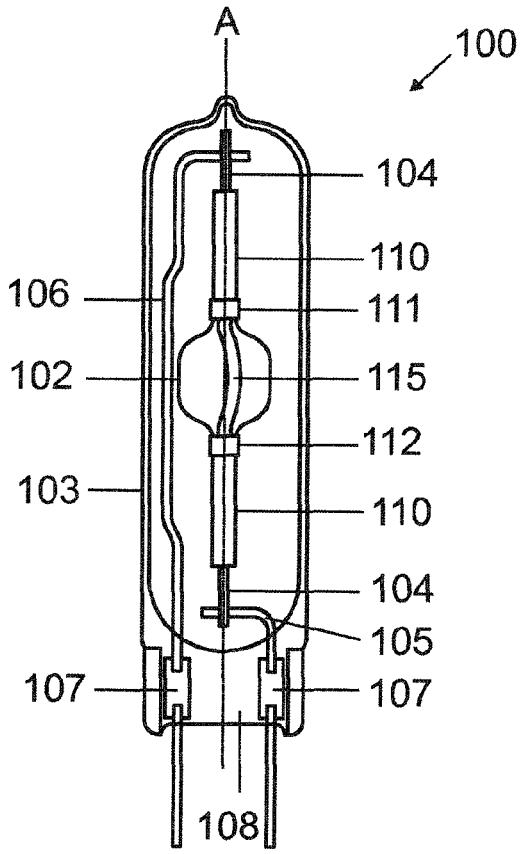

FIG. 9 shows a discharge vessel 2 which consists of quartz glass, in which film strips 11, 12 are wound around the ends of the discharge vessel in the region of the films in the fuse seal at the ends of the bulbous discharge vessel and are connected to a further film 26.

Figure 10:
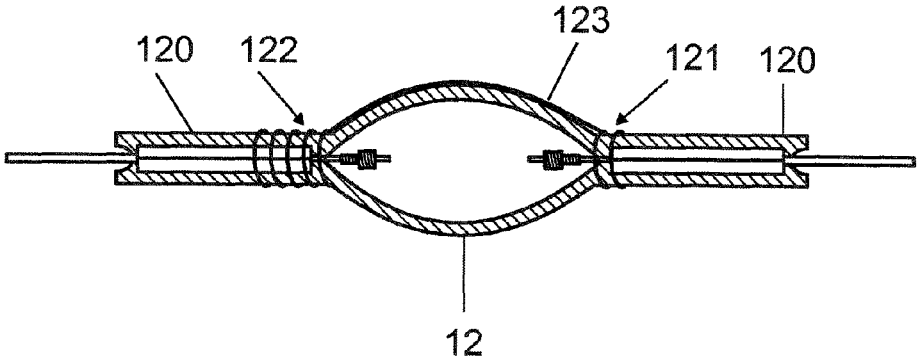

FIG. 10 shows an exemplary embodiment in which wire windings are configured asymmetrically. In this case, for example two to three windings 21 are located on one pinch seal or fuse seal 20, and for example eight to ten windings 22 on the second pinch seal 20. These two winding parts 21 and 22 are again connected via a wire 23. The turns ratio of the winding should preferably be 2:1 to 4:1. The wire from which the windings 21 and 22 are made is a fine wire with a diameter of from 10 to 400 μm. The small diameter, in particular up to 150 μm, itself already produces sufficiently high field intensities to lower the starting voltage. A good compromise between stability and an effect which promotes starting is a diameter of from 80 to 120 μm.

Figure 11:
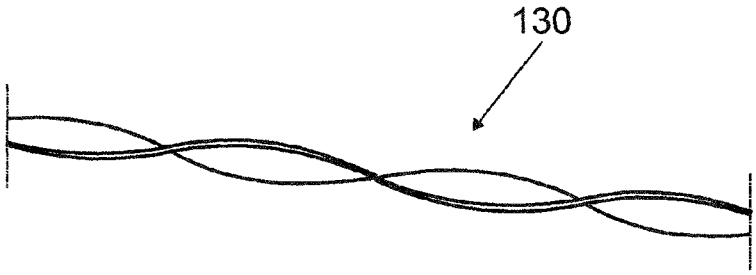

FIG. 11 shows a further exemplary embodiment in which the same basic arrangement as in FIG. 10 is used. However, a specially treated wire 130 is used as the wire, which wire is rolled flat and is in particular also additionally twisted, as illustrated. During the rolling, a thickness of the wire of from approximately 30 to 80 μm is achieved, and the rolled wire is even thinner at the edges. This embodiment demonstrates further improved stability and an increased effect of promoting starting, but it is slightly more cost-intensive owing to the fitting and processing of the wire.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A high-pressure discharge lamp with a starting aid, comprising a discharge vessel, wherein the discharge vessel has two ends with seals, in which electrodes are fastened, wherein the starting aid is fitted on the outside of the discharge vessel, wherein the starting aid has a local field amplifier having a configuration with at least one tip or edge or structure with a small radius of curvature, and wherein the starting aid produces a corona discharge which emits UV radiation into the discharge vessel, wherein the discharge vessel is surrounded by an outer bulb, wherein the outer bulb is filled with ionizable gas, wherein the starting aid is accommodated in the outer bulb, and wherein the gas is selected from the group consisting of noble gases, air, nitrogen or mixtures thereof.

2. The high-pressure discharge lamp as claimed in claim 1, wherein the starting aid is a section of a wire or a wire piece, wherein the starting aid has a configuration in cross section which has edges or a wire section which is round in cross section and has, over a graduated circle, a structure with edges or points.

3. The high-pressure discharge lamp as claimed in claim 1, wherein the starting aid is a fine wire with a diameter of from 5 to 400 μm.

4. The high-pressure discharge lamp as claimed in claim 1, wherein that the starting aid is a spot face on a wire.

5. The high-pressure discharge lamp as claimed in claim 1, wherein the starting aid is an auxiliary part which interacts with at least one section of a wire which is spun onto the wire.

6. The high-pressure discharge lamp as claimed in claim 1, wherein the starting aid is galvanically or capacitively coupled.

7. The high-pressure discharge lamp as claimed in claim 1, wherein the starting aid comprises a material which has a low electron work function.

8. The high-pressure discharge lamp as claimed in claim 1, wherein the starting aid has at least one associated film in the region of the end of the discharge vessel, wherein the film can be part of a fuse seal or pinch seal.

9. The high-pressure discharge lamp as claimed in claim 1, wherein the starting aid is a rolled wire.

10. The high-pressure discharge lamp as claimed in claim 1, wherein the gas in the outer bulb has a cold filling pressure of from 0.1 mbar to 1 bar.

11. The high-pressure discharge lamp as claimed in claim 2, wherein the configuration in cross section is a polygon with straight or curved sections.

12. The high-pressure discharge lamp as claimed in claim 5, wherein the starting aid is a film which is held at the end of the discharge vessel by means of the wire or a fine wire with a diameter of from 5 to 400 μm.

* * * * *